United States Patent [19]

Oberhofer et al.

[11] Patent Number: 4,890,786

[45] Date of Patent: Jan. 2, 1990

[54] FIBRE DRUM WITH REINFORCEMENT COLLAR

[75] Inventors: Lanny A. Oberhofer, Homewood; Donald E. Miller, Mt. Prospect, both of Ill.

[73] Assignee: Sonoco Products Company, Hartsville, S.C.

[21] Appl. No.: 255,561

[22] Filed: Oct. 11, 1988

[51] Int. Cl.[4] ..... B65D 3/10

[52] U.S. Cl. ..... 229/5.7; 229/5.5

[58] Field of Search ..... 229/5.5–5.7; 220/67, 71

[56] References Cited

U.S. PATENT DOCUMENTS

| | | | |
|---|---|---|---|
| 1,229,326 | 6/1917 | Schank . | |
| 2,050,028 | 8/1936 | Wilcox . | |
| 2,290,536 | 7/1942 | Chamberlain . | |
| 2,321,857 | 6/1943 | Rigerman . | |
| 2,511,481 | 6/1950 | Schneider . | |
| 2,696,340 | 12/1954 | Bergstrom . | |
| 2,727,673 | 12/1955 | Bergstrom . | |
| 2,810,492 | 10/1957 | Bergen et al. . | |
| 3,107,037 | 10/1963 | Rodish . | |
| 3,142,433 | 7/1964 | Balocca . | |
| 3,315,865 | 4/1967 | Bracht . | |
| 3,405,439 | 10/1968 | Uemura | 220/67 |
| 3,487,989 | 1/1970 | Rausing et al. . | |
| 3,505,722 | 4/1970 | Ullman . | |
| 3,524,568 | 8/1970 | Nughes . | |
| 3,712,530 | 1/1973 | Croley | 229/5.7 |
| 3,955,705 | 5/1976 | DuBois et al. . | |
| 4,428,741 | 1/1984 | Westphal . | |
| 4,457,465 | 7/1984 | Shepard et al. . | |
| 4,720,038 | 1/1988 | Shepard . | |

FOREIGN PATENT DOCUMENTS

| | | | |
|---|---|---|---|
| 1119756 | 12/1961 | German Democratic Rep. | 200/67 |

OTHER PUBLICATIONS

Government Drawing of Part No. 9342857, original date of drawing Jul. 13, 1984.

*Primary Examiner*—Gary Elkins

*Attorney, Agent, or Firm*—Dennison, Meserole, Pollack & Scheiner

[57] ABSTRACT

A large capacity fibre shipping drum incorporating a stabilizing chime about one or both ends thereof wherein the sidewall is reinforced against rupture by an encircling collar of stiff material underlying the free edge of the skirt of the chime to a minor degree and projecting beyond the chime skirt for a minimal distance relative to the overall height of the drum.

14 Claims, 3 Drawing Sheets

FIBRE DRUM WITH REINFORCEMENT COLLAR

BACKGROUND OF THE INVENTION

The present invention is concerned with fibre drum construction, and more particularly relates to a large capacity integrally-lined fibre drums, for example 55 gallon, 21.5 inch diameter drums approximately 37 to 38 inches tall, wherein drum breakage or rupture from accidental dropping or similar abuse is a substantial problem limiting utilization of the drums.

Integrally-lined fibre drums have been used for many years for packaging and shipping of dry goods and, to some degree, nonhazardous liquids. Such drums have not been used with hazardous liquids due to concern about their ability to withstand the abuse to which the drums may be subjected during handling and shipping. To qualify for such use, the drum must pass various standards, for example as set forth in U.S. Department of Transportation (DOT) Regulations which include the requirement that a 55 gallon drum, filled with water to 98% capacity, must not leak when dropped from a four foot height onto a solid concrete surface so as to land diagonally on a corner chime, i.e., the junction of the top or bottom with the sidewall of the drum.

Steel drums, plastic drums and fibre drums with loose plastic inserts will normally pass the DOT "drop test". However, when commercially available, integrally-lined fibre drums are subjected to the four-foot diagonal drop test, they typically fail by one or more of the following:

(1) Catastrophic sidewall tearing;

(2) Pullout or tearout of the bottom heading from the steel chime band; and (3) Limited extent tearing (fracture) of the sidewall adjacent to the steel chime band.

The typical fibre drum is an open-top paperboard barrel. Most often the drum bottom, called the bottom heading, and the tubular sidewall are made of paperboard. Top closures, called covers, are usually made of paperboard, sheet metal, or plastic. Wooden bottoms and covers are also used, but in only a small fraction of domestically produced drums.

Fibre drums can be assembled by a variety of processes including gluing, stapling, etc. By far the most widely used method of fibre drum construction employs steel chime bands at both the top and bottom of the drum. During manufacture, a relatively loose assembly consisting of a tubular sidewall, top and bottom chime bands, and bottom heading is converted into a sturdy unitary structure by a sequence of grooving, curling, and crimping operations performed simultaneously on the fibre and metal components.

At the bottom of the finished drum, the chime band, tube end portion, and bottom heading are formed together to define a closed bottom with a reinforced sealed annular periphery.

At the top of the finished drum, the chime band is curled over the end of the fibre tube to form a circumferential bead against which the cover can be separately sealed. The cover will normally be held in place by a C-shaped split steel locking band with a channel cross-section. The opening in the band is spanned by a toggle mechanism which pulls the open ends of the band toward each other after the band has been slipped over the cover and engaged with the recess or groove formed in the top chime and sidewall. The upper leg of the C-shaped band bears against the top of the cover near its perimeter, while the lower leg bears against the part of the chime band forming the upper surface of the top groove.

Alternatively, the finished drum can be a tight-head drum wherein a top heading is permanently mounted in a manner duplicating the mounting of the bottom heading. In such case, the top heading will include appropriate bung and vent fittings.

U.S. Pat. Nos. 2,696,340 and 2,727,673, issued respectively Dec. 7, 1954 and Dec. 20, 1955, to Bergstrom, illustrate conventional drum construction features.

Drum constructions often include special features. The inner plies of the tube, top heading and bottom heading of a drum for liquid contents may be made of plastic/paper laminates. Tubes for drums which must be able to withstand outdoor storage are wound with a waterproof adhesive. The inner surface of drums for certain chemical or food products may require special gas, i.e. oxygen, impermeable linings.

For many years the typical general purpose fibre drum has been constructed with steel chime bands for reinforcement and joint stability. While such reinforcement has sufficed for solid foodstuffs, granular material and the like, problems arise from the expansion of the use of fibre drums as containers for liquids. Improved resistance to damage from abusive handling, the chief cause of drum failure, has been found to be necessary if integrally lined liquid-tight fibre drums are to comprise a viable alternate to the heavier, more costly metal drums, plastic drums, or fibre drums with loose plastic inserts. In insuring product quality, assignee company routinely subjects its drums to industry standard tests, including the Department of Transportation (DOT) test which simulates the accidental dropping of a drum from a loading dock or truck body.

Fibre drums of appropriately conventional robust construction and containing an approved dry granulated test material can pass this test. However, integrally-lined fibre drums containing aqueous liquid contents have heretofore been unable to pass the test, i.e., to survive the 4-foot drop without leaking. In actuality, such drums have been seen to fail with drops as low as two feet.

Experimentation conducted with conventionally constructed fibre drums revealed the nature of the impact zone sidewall deformations and fractures. These tests indicated that the destructive deformation patterns resulted from unfavorable interactions between the chime skirt and sidewall at two locations in the impact region outwardly spaced to the opposite sides of the strike point. The chime bands of the test drums were relatively wide, extending about 1.3 inches below the horizontal surface of the chime groove. Long chime skirts increase stacking strength, a desirable characteristic in a drum intended to be able to withstand abusive service. The appearance of a failed drum at and near its fracture sites suggested that deformations might be less severe if the chime skirt did not extend down the sidewall from the groove. Subsequently, two drums with chime skirts of this kind were drop tested. Deformations were noted to be considerably less severe, but both drums continued to sustain small destructive fractures of the usual type. Thus, reduction of the chime skirt is not a viable solution in that this would both reduce the effectiveness of the chime for its intended purpose, and at the same time not preclude drum failure.

The present invention, resulting from not only a recognition of the problem but also a recognition as to the forces and conditions which produce the problem, uniquely avoids drum rupture or fracture in a simple and inexpensive manner which allows for use of conventional drum construction and materials.

SUMMARY OF THE INVENTION

It is the primary purpose of the present invention to produce large capacity integrally-lined fibre drums, for example 28 to 75 gallon drums, which comprise a commercially viable alternate for the conventional all steel drum as a liquid container. Pursuant thereto, the invention is particularly concerned with prevention of sidewall failure as normally occurs with standard fibre drum construction during the DOT 4-foot diagonal drop test.

A secondary purpose of the present invention is to improve the overall performance of non-integrally lined drums. These include composite drums, that is fibre drums with loose plastic inserts, as well as fibre drums for dry or semi-liquid use.

The prevention of sidewall fracture or failure is achieved by modifying the deformation pattern in the region of the drum wall below and in spaced adjacent relation to the chime groove, i.e., near the lower or inner edge of the chime band. It is fortunate the destructive deformations occur in this area in that if the destructive deformations extended higher, the basic groove/crimp geometry, which is the accepted industry-wide standard for forming a satisfactory joint between heading and sidewall, might have to be altered substantially to allow for modification of the deformation pattern in the manner of the invention. With the fracture zone located as is, the basic groove/crimp geometry is retained with only minor revisions of groove/crimp tools and equipment needed.

In accord with the invention, the basic commercial shipping container or drum is provided with a reinforcing collar or band encircling the drum in inwardly spaced relation to the chime groove. The collar is positioned sufficiently inward of the chime groove to avoid interference with the groove chuck of the crimp tooling, and thus not require retooling or changes in standardized drum end-forming procedures.

The collar will be overlapped by the chime skirt with the overlap ranging from approximately 1/16 inch to approximately ½ inch. While greater overlaps are possible no particular advantages derive therefrom.

In a standard chime band and drum body or tube assembly procedure, the chime band is made by forming flat strip steel into a hoop and welding the ends of the strip. The hoop is formed to a diameter which makes it a snug fit on the fibre tube. In the drum of the present invention, an additional operation is necessary to accommodate the collar. The inner edge, and an adjacent portion of the wall of the chime band, must be expanded or laterally offset to enable it to fit over the collar. Such an expansion is easily effected during formation of the chime hoop and does not affect the more complex chime crimping procedure. The mounting of the chime band will normally require "shoe-horning" because of the snug band-to-tube fit and the slight lack of roundness of both tube and band.

The reinforcing band or collar of the invention is located away from the end of the tube in that its purpose is to modify sidewall deformation in standard fibre drum construction, a phenomenon which occurs not at the end of the tube, but in an inwardly spaced zone near the inner edge of the chime band. The inward positioning of the collar is also significant in that the chime crimp joint which has become the accepted structure for making a secure connection between a drum sidewall and heading would be rendered impractical if the reinforcing collar extended to the end of the tube. In particular, the excess thickness which would result at the tube end would be difficult to accommodate.

The reinforcing collar is preferably to be formed of a relatively stiff deformable material, that is a material which is not readily stretchable or has appreciable elastomeric properties. Some materials found to be particularly appropriate, and which for purposes of this disclosure are considered "stiff" materials, include polyethylene, paper, fibre board and metal. Experimentation has indicated effective results with a 3 inch wide high density polyethylene collar ⅛ inch thick, as well as paper collars 1 to 3 inches wide and as thin as 0.08 inch. As paper is, in most cases, the least expensive material, it will be the preferred material. As an example of an inappropriate elastomeric material, a narrow collar of urethane rubber, while causing a shift in the position and shape of the deformations, also allowed a catastrophic failure to occur in the tube wall.

DESCRIPTION OF PREFERRED EMBODIMENTS

Figure 1:
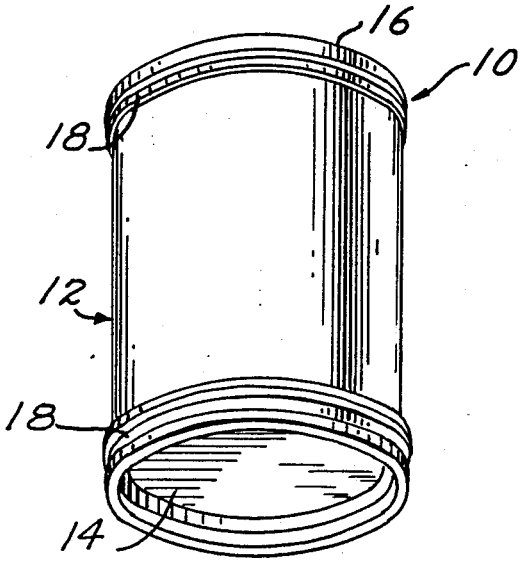
Fig. 1. (PRIOR ART)
FIG. 1 is a bottom perspective view of a fibre drum constructed in accord with the prior art.

FIG. 1 is a perspective view of a typical large capacity drum 10, for example a 55 gallon drum, comprising a fibre or paperboard tube wall 12 with a bottom heading 14 and a top closure or heading 16. The opposed ends of the tube wall 12 are provided with steel chimes 18, which are integrally rolled with the tube ends for rigidification and stabilization of the joinders provided between the tube wall and, respectively, the bottom heading 14 and the top closure 16.

Figure 2:
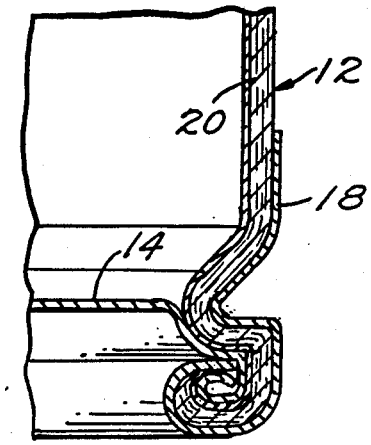
Fig. 2. (PRIOR ART)
FIG. 2 is an enlarged cross-sectional detail through the lower edge portion of the drum of FIG. 1 illustrating the chime and rolled edge.

The joinder with the bottom heading, as suggested in the enlarged cross-sectional detail of FIG. 2, is conventionally effected simultaneously with the rolling of the tube end and chime. The top closure 16 may be similarly formed and define a tight-head drum. Alternatively, the drum may be an open-top drum with a removable lid clamp-locked to the rolled edge of the container and mounted chime. Similar constructions will be noted in the Shepard et al U.S. Pat. No. 4,457,465, issued July 3, 1984 and Bergstrom, 2,696,340. The drum may also include an integral barrier or liner 20 of liquid and/or gas impervious material.

Figure 3:
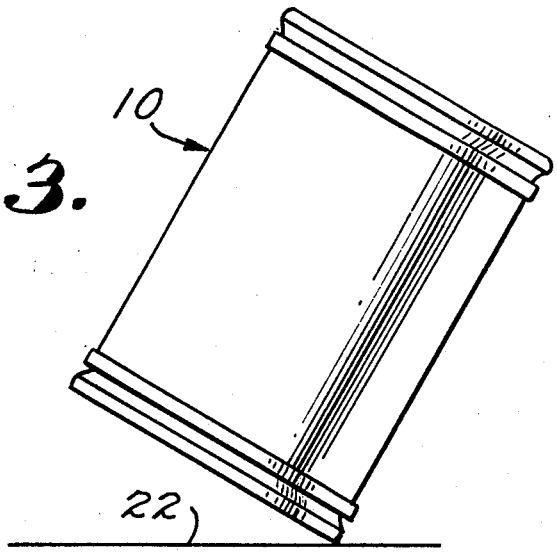
FIG. 3 is a schematic illustration of the drum subjected to a drop test.

The integrally lined fibre drum 10 as above described, assuming conventional side wall thickness and composition, has repeatedly failed the DOT drop test. This test, as generally suggested in FIG. 3, involves filling the drum with water to 98% capacity and dropping the drum from a four-foot height onto a solid concrete surface 22 to land diagonally on the juncture of the top or bottom with the sidewall of the drum. Typically, and noting FIG. 4 along with the sectional details of FIGS. 5, 6 and 7, the impact of the drum, because of the angle at which the drum strikes the landing pad surface 22, will, at the strike point or zone 24 be driven radially and axially inward with the sidewall 12 folding over the chime 18 into a snug Z-shaped formation. In spite of the severity of this deformation, this portion of the sidewall normally does not fracture. Rather, the damage consists of a few minor surface cuts inflicted by the chime and insignificant surface abrasion where the folded over sidewall 12 has contact with the concrete landing pad 22.

Figure 5:
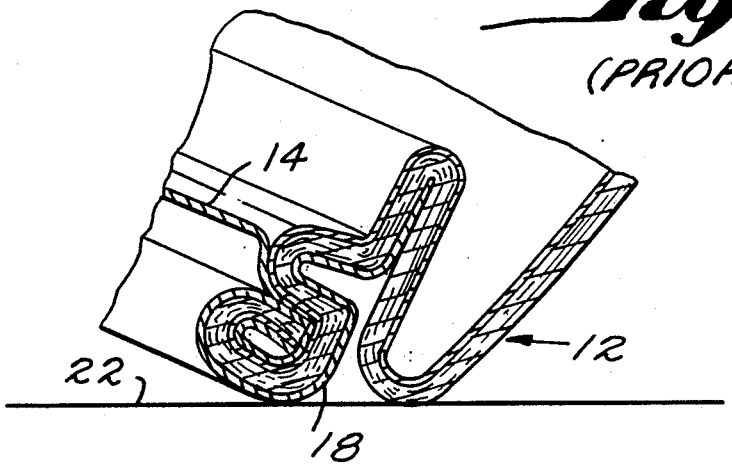
Fig. 5. (PRIOR ART)
FIG. 5 is an enlarged cross-sectional detail of drum deformation at the point of impact of a prior art drum.
Figure 6:
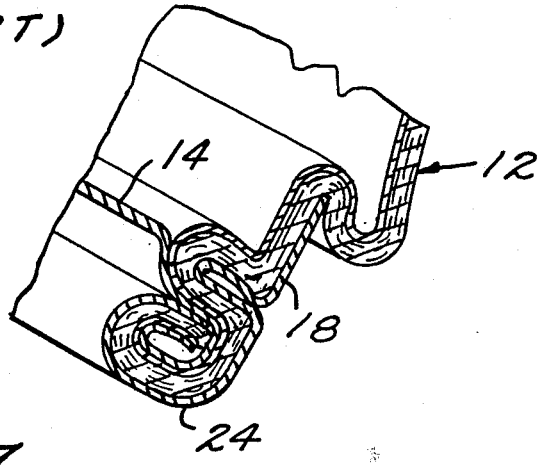
Fig. 6. (PRIOR ART)
FIG. 6 is an enlarged cross-sectional detail of the prior art drum at an intermediate distance outward from the point of impact.
Figure 7:
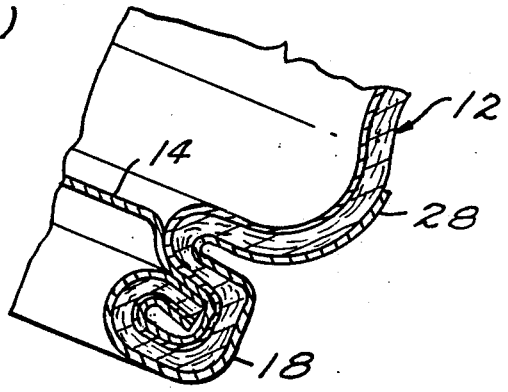
Fig. 7. (PRIOR ART)
FIG. 7 is an enlarged cross-sectional detail more remote from the point of impact and at the transition zone whereat fracture normally occurs in a prior art drum.

Sidewall fracture almost always takes place in one or both of two locations typically 6 to 8 inches to each side of the center of the initial strike zone. These locations, designated by reference numeral 26, are transition zones within which the Z-shaped fold-over pattern of FIG. 5 has changed rather abruptly to a simple bulge, noting FIG. 7, that does not overwrap the steel chime, but rather bell-mouths the chime skirt as at 28. FIG. 6 illustrates an intermediate point between the strike zone of FIG. 5 and the transition zone of FIG. 7 whereat the actual rupture or fracture occurs.

Figure 4:
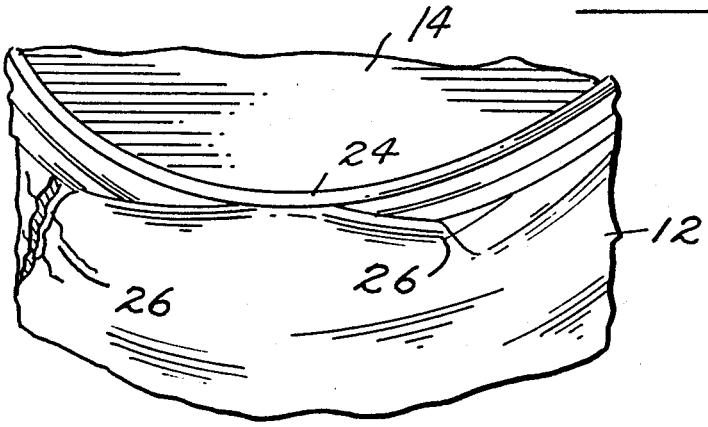
Fig. 4. (PRIOR ART)
FIG. 4 is a perspective representation of drum deformation and fractures resulting from a drop test of a prior art drum.

The transition zone deformation geometry tends to differ somewhat from drum to drum or even from zone to zone on the same drum. For example, FIG. 4 illustrates the results of an actual drop test wherein the right-hand transition zone sustained a moderate fracture while the left-hand transition zone sustained a catastrophic fracture, both on the same drum. In some instances, high localized circumferential tensile strains appear to be responsible for fracture of the fibre drum sidewall. In other instances, it is clear that the fracture occurs in a region of high radial-plane shear.

While such fractures in integrally-lined fibre drums can be avoided by utilization of exceptionally thick walls or double walls, to do so would be structurally impractical and not economically feasible, both because of manufacturing problems and/or expensive procedure modifications, and because of non-justifiable materials and manufacturing costs.

Figure 8:
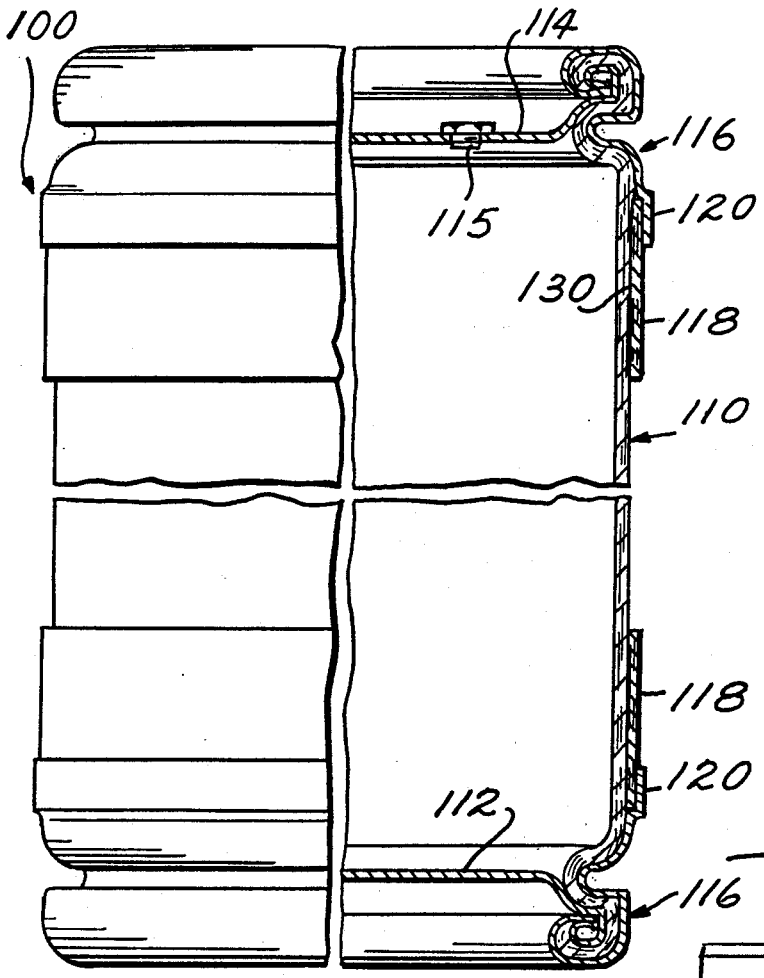
FIG. 8 is a partial elevational view, with portions in cross-section, illustrating a tight-head drum with mounted reinforcing collars in accord with the present invention.
Figure 9:
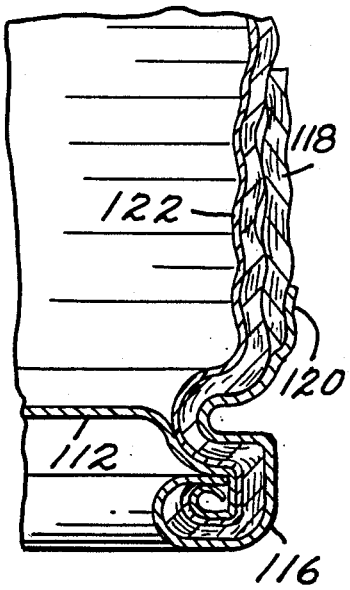
FIG. 9 is a cross-sectional detail illustrating drum deformation at the point of impact of the drum of FIG. 8 when subjected to a conventional drop test.
Figure 10:
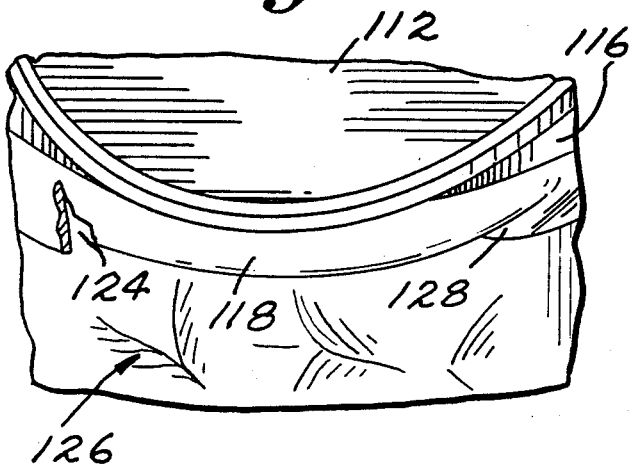
FIG. 10 is an perspective representation of typical deformation resulting from the drop testing of a fibre drum constructed in accord with the present invention.

Referring specifically to FIGS. 8, 9 and 10, reference numeral 100 illustrates an integrally-lined fibre drum or shipping container constructed in accord with the present invention. The drum, for example of 55 gallon capacity, includes, in the manner of the conventional tight-head drum 10 of FIG. 1, a fibre or paperboard tube wall 110 with a bottom heading 112 and top closure 114 in the form of a heading which duplicates the bottom heading 112. When using a crimped-in top heading, the heading will be provided with appropriate bung and vent fitments 115, to facilitate filling and emptying. The joinder between the tube wall 110 and the respective end members is effected conventionally by appropriate crimping means utilizing a chime 116, preferably of steel, again in accord with typical procedures.

The integrally lined fibre drum 100 of the invention differs from the conventional drum 10 by the provision of a reinforcing band or collar 118 circumferentially about the tube sidewall 110 at the free edge of the chime skirt. Such a collar 118 will, in each case, be associated with the lower end of the drum and may, as desired, also be provided about the top of the drum as illustrated, particularly in tight-head drums.

Figure 11:
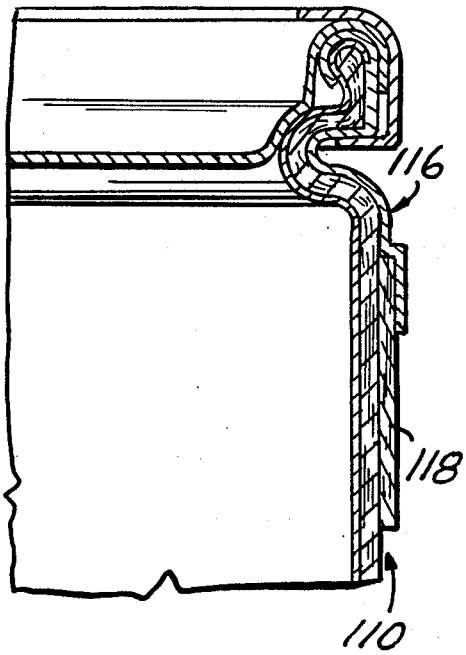
FIG. 11 is a cross-sectional detail of an open-top drum with reinforcing collar.

FIG. 11 illustrates the provision of the collar 118 about the top of an open-top drum. The relationship of the collar to the chime 116 and sidewall 110 will duplicate that in the tight-end drum and will provide similar significant advantages.

The collar 118 will typically be 1 inch to 3 inches wide and extend ⅛ inch to ½ inch beneath the chime skirt. The chime skirt, at 120, will in turn be slightly laterally or radially outwardly offset to accommodate the peripheral edge portion of the collar 118. Providing an overlap within this range, assuming a typical width chime, locates the collar sufficiently remote from the chime groove to avoid interference with standard crimp tooling. This relationship will be readily appreciated from FIG. 8.

The sidewall thickness of a typical 55 gallon drum 100 will be on the order of 0.125 to 0.165 inch. The collar thickness, assuming a collar of paper fibre, paper-like material, or the like, may be approximately 0.100 to 0.125 inch. The thickness may actually be substantially less depending upon the nature of the material. For example, the collar thickness may be as low as 1/20 of the sidewall thickness if light gauge steel is used. The thickness range suggested above permits use of a board variety of collar materials, including, in addition to paperboard and metals, high density polyethylene. The aforementioned materials, while deformable to allow for formation about the drum, for the purposes of the invention, are considered "stiff" materials as opposed to elastomeric materials or materials incorporating an appreciable degree of elasticity. The presence of substantial elasticity, as for example would be present in a narrow collar of urethane rubber, would in most cases not prevent the fracturing.

The collar width or height can be as narrow as 5/8 inch or as wide as one-third of the overall height of the finished drum, terminating well short of the medial plane of the drum. However, little practical additional advantage is achieved at the upper end of this range. A range of 1 to 3 inches has been found to provide particularly desirable results in insuring no destructive fracturing in the drop test. Collars with a width within this range, in addition to being highly effective, are economically feasible and aesthetically acceptable. As one example, actual four foot drop test results have found that collars of approximately 0.104 to 0.106 inches thick made of 8 plies of silicate-glued 0.013 kraft paper of 1, 2 and 3 inch widths have effectively prevented fractures.

Similar tests have successfully been conducted from heights as high as six feet.

With regard to securement of the collar 118 to the sidewall 110, while full adhesive securement would normally be thought to be preferred, it has been determined that moderate adhesion, or in fact a snug frictional mounting, actually provides superior results.

For example, moderate adhesion enhances independent behavior between the sidewall 110 and the collar 118 during the severe deformation which occur in a destructive impact. That is, the sidewall and collar are not forced to perform as a unit. Noting FIG. 9, and in particular with moderate adhesion, there is a tendency for the sidewall to "accordion" as at 122 with the collar and sidewall sliding relative to each other. Such an action may deform or even tear the collar. However, there will be no destructive fracture of the sidewall.

FIG. 10 illustrates the results of an actual drop tested fibre drum with a collar. As in this case a collar tear at 124 may occasionally occur. However, the sidewall deformation 126 will be away from the collar and of a nondestructive nature.

Noting 128, the collar, rather than tearing, may merely deform. The collar illustrated in FIG. 10 represents a 3 inch kraft paper collar. When collars as narrow as 1 inch are used, the collar itself, at the strike zone, may actually retract completely into the chime. However, the excessive foldover and bulging of FIGS. 5–7 will not occur, and destructive rupture of the sidewall will be avoided.

Moderate adhesion between the collar and sidewall can be provided by using low-strength adhesive, and/or applying adhesive to a limited area of the collar and sidewall interface. Such procedures could be used if the collars were made by convolute winding of strip paper on the tube sidewall with the adhesive applied during the winding operation. The adhesive in general is indicated at 130.

If reliance for securement of the collar is to be based on a frictional engagement therebetween, the collar can be preformed and installed on the tube with a press-fit using tooling which "shoehorns" the tube into the collar. With this method, it would also be desirable to apply circumferential beads of waterproof sealant to one or both edges of the collar in a subsequent operation. A collar made of fibre or other material vulnerable to degradation from moisture may have its edges, outer surface and/or ply interfaces coated with waterproof materials or sealants for protection against exposure to wet conditions.

It has been determined that a collar which has been fully bonded with a complete or full coverage layer of adhesive between the tube wall 110 and collar 118 will also provide adequate protection in that the fibre-to-glue-to-fibre interface will separate during deformation of tube wall 110. Using a water-proof glue, such as hot-melt adhesive, between 110 and 118, plus hot-melt between all plies of the collar has been found to provide a firm bond and excellent water resistance to the paper collar.

While the collar cross-section will normally be plain and rectangular, that is configured in the manner of an ordinary circular cylinder, the collar may have circumferential and/or axial ribbing, beading, corrugations, or the like. Such variations, if provided, would normally be in a plastic or metal collar and would provide additional protection to the drum sidewall by, as an example, increasing the energy absorbing capacity of the collar.

The collar of the invention will be applied to one or both ends of a fibre shipping container or drum of 28 to 75 gallons capacity. Such drums conventionally incorporate metal chimes as a necessary means for insuring the integrity between the sidewall and the end panels, and also as a means for effectively increasing the stacking strength of the drums. However, it appears that, under certain circumstances such as for example brought forth by the "drop test", the fibre sidewall of the drum must itself be shielded from the metal chime edge. The problems generated at the chime edge have been detailed above. The reinforcing collar of the present invention has been devised specifically as a means for protecting the fibre sidewall in a conventional fibre drum without requiring appreciable changes in manufacturing techniques, materials used, or basic costs. The collar, preferably on the order of 1 to 3 inches wide, can actually be formed from the same material as the sidewall, convolute wound layers of kraft paperboard, thin metal, or the like, each of which provides a stiff or non-elastomerically extensible collar which underlies the inner edge portion of the chime for a fraction of an inch and projects therebeyond for a total width of preferably no more than 3 inches and in any case no more than one-third the height of the drum.

The reinforcement provided by the collar, effectively redirects the stresses of a "drop test" impact to preserve the integrity of the drum, even in such instances wherein the collar itself may tear.

While the reinforcement collar of the invention has particular significance in integrally-lined fibre drums, it can also be used to reinforce other types of fibre drums. For example, the collar will effectively reinforce a fibre drum having an inexpensive loose thin plastic insert which, in itself, provides little practical fracture resistance.

The foregoing is considered illustrative of the principles of the invention. Variations and modifications within the scope of the invention and encompassed by the following claims may occur to those skilled in the art.

We claim:

1. In a fibre drum of predetermined height, a fibre tube wall with first and second ends, an end member overlying said first end, a metal chime encircling said tube wall at said first end and extending inwardly of said first end along an end portion of the tube wall immediately adjacent said first end, said tube end portion and chime being formed to define a stabilized end portion for reception of said end member, said chime including a free peripheral edge about said tube wall inward of said first tube wall end; the improvement comprising reinforcement means for precluding tube wall fracture adjacent said chime, said reinforcement means being dimensioned to partially underlie the free edge of said chime peripherally about said tube wall and extend a minor distance beyond said chime for a distribution of destructive forceinduced stresses outward of said chime.

2. The fibre drum of claim 1 wherein said reinforcement means comprises a collar of stiff material with substantially inelastic properties.

3. The fibre drum of claim 2 wherein said collar is formed of fibre material.

4. The fibre drum of claim 2 wherein said chime, adjacent the free edge thereof, is radially outwardly offset for accommodation of a portion of the collar therebeneath.

5. The fibre drum of claim 4 wherein said collar has a width within the range of 5/8 inch and one-third the predetermined height of the drum.

6. The fibre drum of claim 4 wherein said collar has a width within the approximate range of 1 inch to 3 inches.

7. The fibre drum of claim 2 wherein said drum includes an end member and chime at the second end of said tube wall, a second collar partially underlying and extending a minor distance beyond the chime at the second end, said collars terminating remote from each other and positioned solely adjacent the respective ends of the tube wall.

8. The fibre drum of claim 2 including adhesive means providing moderate adhesion of said collar to said tube wall.

9. The fibre drum of claim 8 wherein said adhesive means comprises a low-strength adhesive.

10. The fibre drum of claim 8 wherein said adhesive means comprises an adhesive applied to a limited area between said collar and said tube wall.

11. The fibre drum of claim 2 including a firm full coverage adhesive bond between the collar and the tube wall.

12. The fibre drum of claim 11 wherein said adhesive bond provides water resistance to said collar.

13. The fibre drum of claim 12 wherein said adhesive bond includes a hot-melt adhesive.

14. The fibre drum of claim 2 wherein said collar is frictionally retained on said tube wall.

* * * * *